US008007301B2

(12) United States Patent
Andersen et al.

(10) Patent No.: US 8,007,301 B2
(45) **Date of Patent: *Aug. 30, 2011**

(54) ELECTRICAL CONNECTOR

(76) Inventors: Claus Andersen, Kolding (DK); Preben Bonde, Losning (DK)

( * ) Notice: Subject to any disclaimer, the term of this patent is extended or adjusted under 35 U.S.C. 154(b) by 0 days.

This patent is subject to a terminal disclaimer.

(21) Appl. No.: 12/860,774

(22) Filed: Aug. 20, 2010

(65) Prior Publication Data

US 2010/0317213 A1 Dec. 16, 2010

Related U.S. Application Data

(63) Continuation of application No. 12/395,502, filed on Feb. 27, 2009, now Pat. No. 7,806,711.

(51) Int. Cl.
*H01R 13/64* (2006.01)

(52) U.S. Cl. ..... 439/251; 439/475; 439/821

(58) Field of Classification Search ..... 439/251, 439/475, 821, 857

See application file for complete search history.

(56) References Cited

U.S. PATENT DOCUMENTS

| | | | | |
|---|---|---|---|---|
| 4,453,792 | A | 6/1984 | Bright et al. | |
| 4,867,713 | A | 9/1989 | Ozu et al. | |
| 5,098,318 | A | 3/1992 | Suter | |
| 5,431,576 | A | 7/1995 | Matthews | |
| 5,482,481 | A | 1/1996 | Takeuchi | |
| 6,139,347 | A | 10/2000 | Nebon et al. | |
| 6,280,216 | B1 | 8/2001 | Bernier et al. | |
| 7,795,551 | B2 * | 9/2010 | Narayanan et al. | 200/255 |
| 2003/0166353 | A1 | 9/2003 | Bach et al. | |
| 2009/0047814 | A1 | 2/2009 | Daamen | |

FOREIGN PATENT DOCUMENTS

KR 20-0248041 Y1 10/2001

OTHER PUBLICATIONS

International Search Report for International Application PCT/US2010/025082 dated Sep. 27, 2010, 3 pages.

* cited by examiner

*Primary Examiner* — Gary F. Paumen
(74) *Attorney, Agent, or Firm* — Gilman Clark, LLC

(57) ABSTRACT

An electrically conductive fork includes first and second arm members each having an electrical contact and a pivot portion, the pivot portion configured to receive a portion of a rod, where the first and second arm members are configured to pivot around the rod, and a connector mechanically connecting the first and second arm members in fixed relation to each other prior to insertion of a busbar between the electrical contacts, where the connector is configured to yield to a force imparted on the connector and allow the first and second arm members to pivot around the rod in response to insertion of the busbar between the electrical contacts, and the insertion of the bus bar causes the electrical contacts to separate and pivot the first and second arm members around the rod and impart the force on the connector.

16 Claims, 7 Drawing Sheets

ELECTRICAL CONNECTOR

This is a continuation patent application which claims priority from U.S. patent application Ser. No. 12/395,502 filed on Feb. 27, 2009 and entitled "Electrical Connector," the disclosure of which is hereby incorporated by reference in its entirety for all purposes.

BACKGROUND

High-power electronic equipment uses busbars to transfer high currents which can be on the order of hundreds of amps or more. In order for equipment to be easily connected and disconnected from the busbars, e.g., to allow for removable and replaceable equipment modules and the like, busbar connectors are utilized. In this way, the busbars of one piece of electronic equipment (e.g., a system that houses removable subsystem modules) can be releasably connected to opposing busbars of the subsystem modules. Busbar connectors that are capable of handling the hundreds of amps of current of high power electronic equipment can be very expensive and complicated to manufacture.

Simple, relatively less expensive busbar connectors can be used to connect high-power equipment. These less expensive busbar connectors are often not designed to receive opposing busbars that are misaligned with large tolerances such as +/−2 mm or more (e.g., a 5 mm thick busbar misaligned by 2 mm in any of three dimensions), for example. Thus, using such busbar connectors requires equipment modules with tight tolerances, which increases the cost of the equipment modules and can negate savings offered by the less expensive busbar connectors.

SUMMARY

An exemplary electrically conductive fork in accordance with the disclosure includes a first arm member and a second arm member, each arm member having an electrical contact and a pivot portion, the pivot portion configured to receive a portion of a rod, where the first arm member and the second arm member are configured to pivot around the rod, and a connector mechanically connecting the first arm member and the second arm member in fixed relation to each other prior to insertion of a busbar between the electrical contacts, where the connector is configured to yield to a force imparted on the connector and allow the first arm member and the second arm member to pivot around the rod in response to insertion of the busbar between the electrical contacts, and the insertion of the bus bar causes the electrical contacts to separate and pivot the first arm member and the second arm member around the rod and impart the force on the connector.

Embodiments of such electrically conductive forks may include one or more of the following features. The connector may be configured to yield to the force imparted on the connector by breaking upon insertion of the busbar between the contact points. The connector may press fit into a slot of at least one of the first arm member and the second arm member and the connector may be configured to yield to the force imparted on the connector by pulling out of the slot upon insertion of the busbar between the contact points. The connector and at least one of the first arm member and the second arm member may be a monolithic piece. The connector and both the first arm member and the second arm member may be a monolithic piece. The connector may mechanically connect the first arm member and the second arm member such that the electrical contacts of the first and second arm members are separated by a gap. The gap may be in a range from about 1 mm to about 3 mm. The first arm member and the second arm member may be configured to transfer an electrical current greater than about 100 amps.

An exemplary electrical connector in accordance with the disclosure includes a rod, a first arm member and a second arm member, each arm member having an electrical contact and a pivot portion, the pivot portion configured to receive a portion of the rod, where the first arm member and the second arm member are positioned on opposing sides of the rod and configured to pivot about the rod. The electrical connector further includes a bias member connected to the first arm member and the second arm member and biasing the pivot portions of the first arm member and the second arm member against the rod, and a connector member mechanically connecting the first arm member and the second arm member in fixed relation to each other prior to the bias member being connected to the first arm member and the second arm member, where the connector member is configured to yield to a force imparted on the connector member and allow the first arm member and the second arm member to remain in contact with the rod while pivoting about the rod in response to insertion of a busbar between the electrical contacts of the first arm member and the second arm member.

Embodiments of such electrical connectors may include one or more of the following features. The connector member may configured to yield to the force imparted on the connector member by breaking upon insertion of the busbar between the electrical contacts. The connector member may be press fit into a slot of at least one of the first arm member and the second arm member and the connector member may be configured to yield to the force imparted on the connector member by pulling out of the slot upon insertion of the busbar between the electrical contacts. The electrical contacts may be contoured to present a non-perpendicular face relative to an insertion direction of the busbar and to respond to insertion of the busbar to move the electrical contacts away from each other. Each of the arm members may further include a portion of a slot to receive a post to limit rotation about the rod. The portions of the slot may be sized to limit the rotation of the first arm member and the second arm member about the rod to less than five degrees. The pivot portions may be semi-circular to receive a circular rod. The bias member may be a bi-metallic spring. The connector member and at least one of the first arm member and the second arm member may be a monolithic piece. The connector member and both the first arm member and the second arm member may be a monolithic piece. The connector member may mechanically connect the first arm member and the second arm member such that the electrical contacts of the first and second arm members are separated by a gap.

An exemplary method of assembling an electrical connector in accordance with the disclosure includes attaching a rod to a base busbar, positioning a conductive fork member to receive the rod attached to the base busbar, the conductive fork member including a first arm member and a second arm member, each arm member having an electrical contact and a pivot portion, the pivot portion configured to receive a portion of the rod, where the first arm member and the second arm member are configured to pivot around the rod, and a connector member mechanically connecting the first arm member and the second arm member in fixed relation to each other prior to insertion of an opposing busbar, where the connector member is configured to yield to a force imparted on the connector member and allow the first arm member and the second arm member to pivot around the rod in response to insertion of the opposing busbar between the electrical contacts, and while the connector member is connecting the first arm member and the second arm member, connecting a bias member to the first arm member and the second arm member, the bias member configured to bias the pivot portions of the first arm member and the second arm member against the rod.

Embodiments of such a method may include one or more of the following features. Methods may include, subsequent to connecting the bias member, inserting the opposing busbar between the electrical contacts to induce the force on connector member and cause the connector member to yield.

An exemplary electronic device in accordance with the disclosure includes a housing, an input configured to be coupled to a power source, a power frame, an electrical interface coupled to the input and the power frame and configured to provide power to the power frame, and at least one electrical connector electrically connected to the power frame. The at least one electrical connector includes a rod, a first arm member and a second arm member, each arm member having an electrical contact and a pivot portion, the pivot portion configured to receive a portion of the rod, where the first arm member and the second arm member are positioned on opposing sides of the rod and configured to pivot about the rod. The electrical connector further includes a bias member connected to the first arm member and the second arm member and biasing the pivot portions of the first arm member and the second arm member against the rod, and a connector member mechanically connecting the first arm member and the second arm member in fixed relation to each other while the bias member is connected to the first arm member and the second arm member, and the connector is configured to yield to a force imparted on the connector and allow the first arm member and the second arm member to remain in contact with the rod while pivoting about the rod in response to insertion of a busbar between the electrical contacts of the first arm member and the second arm member. The electronic device further includes at least one compartment configured to receive a subsystem module, the subsystem module being configured to be placed in the compartment and including the busbar configured to be inserted between the electrical contacts.

Embodiments of such electronic devices may include one or more of the following features. The connector member may be configured to yield to the force imparted on the connector member by breaking upon insertion of the subsystem module busbar between the electrical contacts.

Various embodiments discussed herein may provide one or more of the following capabilities. Assembly of the busbar connector can be performed manually without a need for complicated machines such as robotic assembly machinery. The busbar connector can be capable of receiving a misaligned busbar, such that the busbar connector can be installed in electronic equipment that is designed with large design tolerances. This can provide cost savings in manufacturing the electronic equipment that is equipped with the busbar connector and/or in manufacturing the electronic equipment to be mated to the busbar connector. Curved electrical contacts on arm members of the busbar connector provide a single line of contact between the arm members and the opposing busbar which helps prevent arcing that can be detrimental to the efficiency of the energy transfer and can damage the busbar and/or the busbar connector. The busbar connector is very predictable in regards to its performance at transferring high electrical currents. This is due, in part, to there being only one bolted connection securing the busbar connector to the base busbar.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The disclosure provided herein describes, among other things, a busbar connector apparatus for electrically connecting busbars of electronic equipment. Exemplary embodiments of busbar connectors are capable of transferring powerful electrical currents between electronic equipment. Currents in the range of 100 to 600 amps or higher can be transferred between busbars joined by the busbar connector. For example, an exemplary busbar connector is configured with a conductive fork including two arm members that are mechanically coupled with a mechanical connector at the time of assembly. While being mated with an opposing busbar, the mechanical connector breaks such that the arm members are separated and can rotate independently during the mating procedure to provide a solid electrical contact with the opposing busbar. The busbar connector is designed such that it is capable of receiving the opposing busbar even if the opposing busbar is misaligned by fairly large positional tolerances in three dimensions and large angular tolerances as well, while still connecting to the opposite busbar with a single point of contact to each arm member.

An exemplary system that uses busbar connectors to transfer high currents is an uninterruptible power supply (UPS) for data centers or other types of facilities using large amounts of backup power. A busbar connector can be used to transfer power between power modules of the UPS and the power frame of the UPS. The power frame is coupled to one or more electrical devices in the data center or facility.

Figure 1:
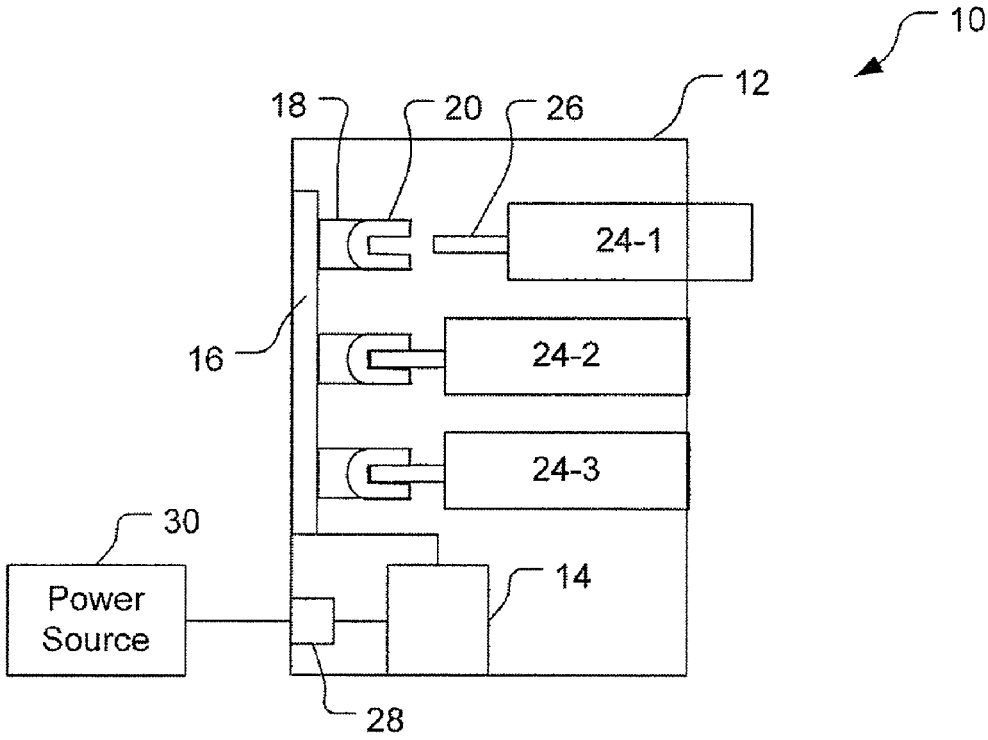
FIG. 1 is a diagram of an electrical system including modular equipment electrically connected by a busbar connector.

Referring to FIG. 1, an electrical system 10 includes a housing 12 configured to house multiple subsystem modules 24. The housing 12 includes an electrical interface 14 connected to an input 28 which is connected to a power source 30. The electrical interface is connected to a power frame 16. the power frame 16 is electrically coupled to a plurality of base busbars 18. A busbar connector 20 is attached to each of the base busbars 18. In this example, the housing 12 is configured to receive three subsystem modules 24-1, 24-2 and 24-3. Each of the subsystem modules 24 includes an opposing busbar 26. Each of the opposing busbars 26 of the subsystem modules 24-2 and 24-3 are releasably coupled to the power frame 16 by one of the busbar connectors 20 and one of the base busbars 18. In FIG. 1, the subsystem module 24-1 is disconnected from the busbar connector 20. Preferably, the subsystem modules 24 can be inserted and replaced without the use of tools by an individual.

The subsystem modules 24 can be connected to the power frame 16 via multiple opposing busbars 26, each coupled to the power frame 16 via a busbar connector 20 and a base busbar 18. The subsystem modules 24 can be contained within slots or on rack shelves in the housing 12. The electrical system 10 is simply an example system including three subsystem modules 24, but other systems can have fewer or more subsystem modules 24. The busbars 18 and 26 can be made of various materials such as tin-plated aluminum, copper or tin-plated copper.

The electrical system 10, is preferably a UPS and the subsystem modules 24 are power modules. The power modules can contain batteries and/or fuel cells. The power modules 24 can be coupled to data center loads such as multiple racks configured to house information technology (IT) equipment. The electrical interface 14 includes electrical transform circuitry to transfer the power received from the power source 30 into another form or voltage level. For example, if the power source 30 is an AC power source, the electrical interface 14 can convert the AC power to DC and from 120 volt or 240 volt to a lower DC voltage. In addition, the electrical interface 14 can provide the power from the power source 30 to charge batteries (not shown) internal or external to the UPS and switch the power provided by the power modules via the busbars 18 and 26 and the busbar connector 20 to power the data center loads.

One example UPS that could utilize the busbar connectors 20 is the Symmetra PX2 manufactured by American Power Conversion Corporation of West Kingsford, R.I. The Symmetra PX2 is designed for data centers or other electronic facilities. The Symmetra PX2 is a UPS that can be expanded by inserting up to 10 power modules into compartments formed in the housing. The power modules of the Symmetra PX2 are each 16 kw such that the UPS can be expanded up to 160 kw. In addition, the power modules can be easily removed for maintenance when connected using the busbar connectors.

The housing 12 comprises standard sized IT rack units generally referred to in terms of U's. A rack unit or U is a unit of measure used to describe the height of equipment intended for mounting in a 19-inch rack or a 23-inch rack (the dimension referring to the width of rack). One "U" is 1.75 inches (44.45 mm) high and comes from the standard thickness of a server unit and is defined in the Electronic Industries Alliance standard EIA-310. Half-rack units are units that fit in a certain number of U, but occupy only half the width of a 19-inch rack (9.5 in or 241 mm). The subsystem modules 24 can be various sizes of U's such as 1 U, 2 U's, 3 U's, 4 U's, 5 U's, 6 U's, 7 U's and more.

Power source 30 can take various forms, such as a device or power distribution system that supplies electrical energy to an output load or group of loads (also known as a power supply unit or PSU). Electrical power sources include power distribution systems and other primary or secondary sources of energy such as power supplies. Power supplies can perform one or more conversions or transformations from one form of electrical power to another desired form such as, for example, converting 120 volt or 240 volt AC supplied by a utility company to a lower DC voltage. Examples of power supplies include batteries, chemical fuel cells, solar power or wind power systems, uninterruptible power supplies, generators and alternators.

The busbar connectors 20 provide an easy way for the subsystem modules 24 to be added and removed from the electrical system 10. Using the busbar connectors 20, different types of equipment can be inserted into the housing 12. The busbar connectors 20 are preferably capable of receiving opposing busbars 26 that are misaligned. For example, an opposing busbar 26 could be misaligned by about 2 mm to about 5 mm in three dimensions. In addition, the opposing busbars 26 could be rotated in one or more axes relative to the busbar connector 20.

Figure 7:
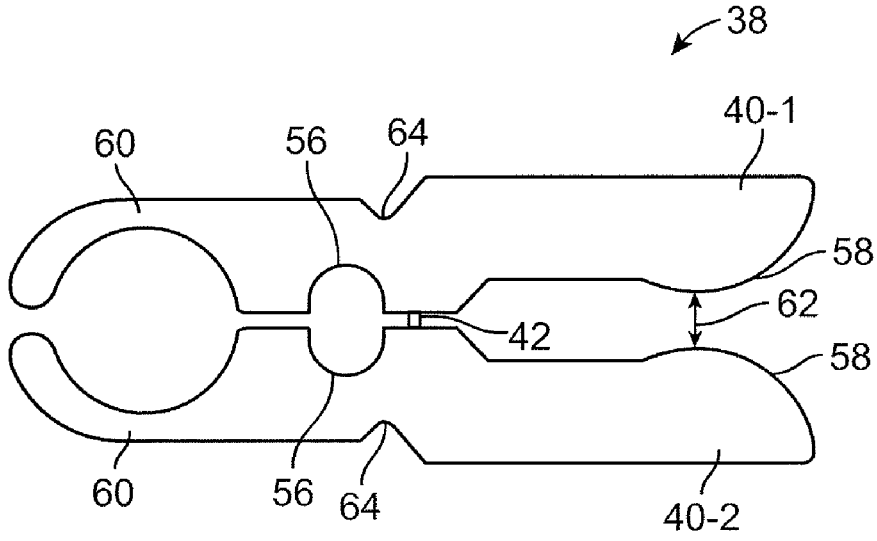
FIG. 7 is a side view of a conductive fork member of the busbar connector of FIG. 2.

Referring to FIGS. 2-7, the busbar connector 20 includes a conductive fork 38 including two arm members 40-1 and 40-2 physically connected by a mechanical connector 42 (best viewed in FIG. 7). The busbar connector 20 also includes a spring 44, a conducting ring 46, an anchor screw (rod) 48 and a washer 50. The busbar connector 20 also includes a stud 52 inserted in a stud-hole 53 formed in the base busbar 18 and an anchor nut 54 inserted in a nut-hole 55 formed in the base busbar 18.

The arm members 40 are configured to rotate about the conducting ring 46. A Each of the arm members 40 includes a curved portion 60 to provide a continuous connection between the arm member 40 and the outer surface of the conducting ring 46. The amount of rotation that the arm members 40 can provide is limited by the stud 52 and a size of a stud cutout portion 56 formed in each of the arm members 40. The rotation of the arm member 40 is stopped when the stud 52 hits the end of the stud cutout portion 56. Preferably, the stud 52 and the stud cutout portions 56 are sized to provide for a rotation in a range from about +/−2 degrees to about +/−5 degrees.

The arm members 40 preferably include rounded contact ends 58. The rounded contact ends 58 are configured such that a force applied to the rounded ends 58 by the opposing busbar 26 will cause the arm members 40 to separate, rotating away from each other to allow insertion of the busbar 26. The rounded contact ends 58 are also configured to provide a single line of contact to the opposing busbar 26 even if the opposing busbar 26 is misaligned in the vertical direction and/or tilted (e.g., rotated about an axis parallel to the axis of rotation of the arm members 40). In the embodiment shown in FIGS. 2-7, the radius of the rounded contacts 58 is about 6 mm.

Referring to FIG. 7, the arm members 40-1 and 40-2 of the conductive fork 38 are mechanically connected, prior to insertion of the opposing busbar 26, by the mechanical connector 42. Preferably, the arm members 40 are manufactured from a single monolithic piece of material and the mechanical connector 42 is made of the same material as the arm members 40. For example, the arm members 40 can be manufactured using laser cutting, molding or pinching equipment. Alternatively, the mechanical connector 42 can be another material added to connect separate arm members 40. For example, the connector 42 could be a weld, adhesive material or plastic.

The arm members 40 are preferably made of silver-plated brass or silver-plated copper but could possibly be made of tin-plated brass or tin-plated copper. Here, with the arm members 40 and the mechanical connector 42 made from the same piece of material, the mechanical connector 42 is also made of silver-plated brass, silver-plated copper, tin-plated brass or tin-plated copper.

Preferably, the mechanical connector 42 is breakable, and sized and configured such that insertion of the opposing busbar 26 will break the mechanical connector 42, facilitating independent rotation of the arm members 40-1 and 40-2. In addition, the gap 62 (see FIG. 7) between the rounded fork ends 58 is large enough to allow manual insertion of the opposing busbar 26 without excessive force while also being small enough to allow forces induced by the insertion of the opposing busbar 26 to break the mechanical connector 42. Exact dimensions can vary. For example, for an opposing busbar 26 that is 5 mm thick, the gap 62 could be in a range from about 0 mm to about 3 mm. The mechanical connector 42 is preferably less than about 1 mm high (the distance between the arm members 40 at the location of the mechanical connector 42), less than about 1 mm wide and of a thickness (into the page in FIG. 7) up to the width of the arm members 40 (e.g., about 2-5 mm thick). Other dimensions for the mechanical connector could be used.

The conductive fork 38 shown in FIG. 7 has spring contact points 64 where the spring 44 applies compressive forces to the arm members 40. The spring contact points 64 are located between the mechanical connector 42 and the semi-circular shaped portions forming the ring-cutouts 60. The spring contact point at this location presses the arm members 40 against the conducting ring 46.

Referring again to FIGS. 2-6, the spring 44 is held in place by the washer 50 and the curved front ends of the spring extending into the indentations of the spring contact points 64. Preferably, the spring 44 is made of a bi-metallic material (e.g., steel and copper) providing a high yield strength. The spring 44 illustrated in FIGS. 2-6 is a "U" shaped spring. Other bias member devices could also be used as alternatives. For example, a coil spring or a piece of elastic material or band could be used instead of the "U" spring 44.

The conducting ring 46 transfers current between the arm members 40 and the base busbar 18. The conducting ring 46, in combination with the anchor screw 48, serves as a pivot point about which the arm members 40 and spring 44 can rotate. Preferably, the conducting ring 46 is made of silver-plated brass, silver-plated copper, tin-plated brass or tin-plated copper.

The conducting ring 46 is secured to the base busbar 18 via the anchor screw 48 and the washer 50. The conducting ring 46 is wider than the arm members 40 such that the conducting ring 46 is secured between the washer 50 and the base busbar 18, but the arm members 40 can rotate about the conducting ring 46 while being held against the conducting ring 46 by the spring 44. Preferably the anchor screw 48 is a so-called "combi-screw" including an internal spring and washer. The internal spring of the combi-screw also helps counteract imbalances in thermal expansion between the anchor screw 48 and other parts of the busbar connector 20 and the base busbar 18. Preferably the screw 48 is made of carbon steel, zinc plated carbon steel or stainless steel. The washer 50 can be made of carbon steel, zinc plated carbon steel or stainless steel.

Preferably, the stud 52 and the stud-hole 53 are sized such that the stud is self-secured in the stud hole 53. Alternatively, the stud 52 and the stud-hole 53 could be threaded. The stud 52 can be made of stainless steel.

Preferably the anchor nut 54 and the nut-hole 55 are sized such that the anchor nut 54 is self-secured in the nut-hole 55. The anchor nut 54 is made to be pressed into the nut-hole 55 of the base busbar 18 and remain in the base busbar 18. However, an anchor nut could also be threaded to be screwed into a threaded nut-hole. The anchor nut 54 is threaded inside in order to receive the anchor screw 48. Preferably the anchor nut 54 and the anchor screw 48 are made of the same material (e.g., carbon steel) such that they have similar thermal expansion properties.

Figure 8:
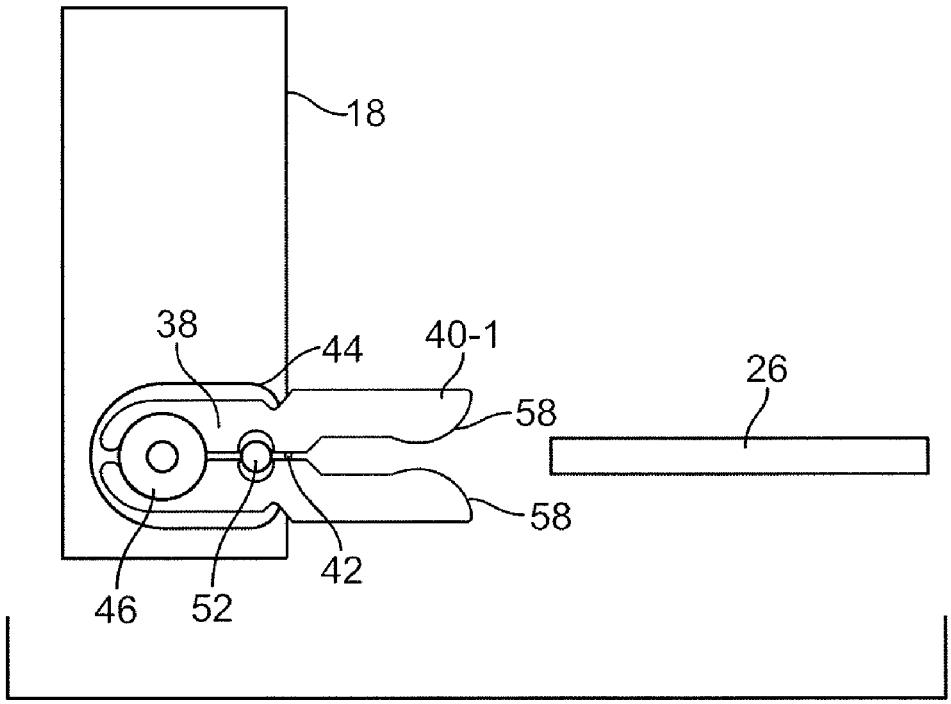
FIG. 8 is a side view of two perpendicular busbars connected by a busbar connector.

Preferably, the connector 20 is configured such that the distance between the stud-hole 53 and the nut hole 55 is smaller than the width of the base busbar 18. In this way, the busbar connector 20 can be oriented at any angle on the base busbar 18, depending on the locations of the holes 53 and 55. In this way, the connector 20 can be oriented to receive an opposing busbar 26 that is oriented at any angle relative to the base busbar 18. If the distance between the holes 53 and 55 is the same for different orientations of the connector 20 relative to the base busbar, then the electrical characteristics are not affected by the orientation and the different orientations do not require new UL (or CE) certification. For example, the connector 20 can be disposed perpendicular to the base busbar 18 as shown in FIG. 8.

Figure 12:
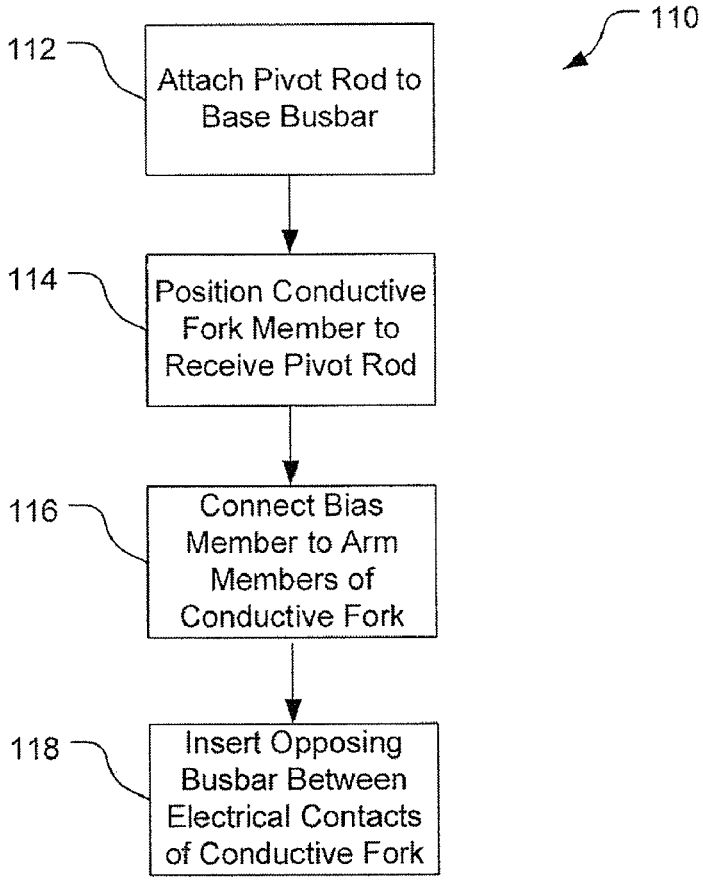
FIG. 12 is a block flow diagram of a process to assemble the busbar connector of FIGS. 2-6.

Referring to FIG. 12, a process 110 for assembling the busbar connector of FIGS. 2-6 includes the stages shown. The process 110 is exemplary only and not limiting. The process 110 may be altered, e.g., by having stages added, removed, or rearranged. Preferably, the process 110 is performed manually. Alternatively, machinery may be used to perform some or all of the assembly process 110.

Figure 2:
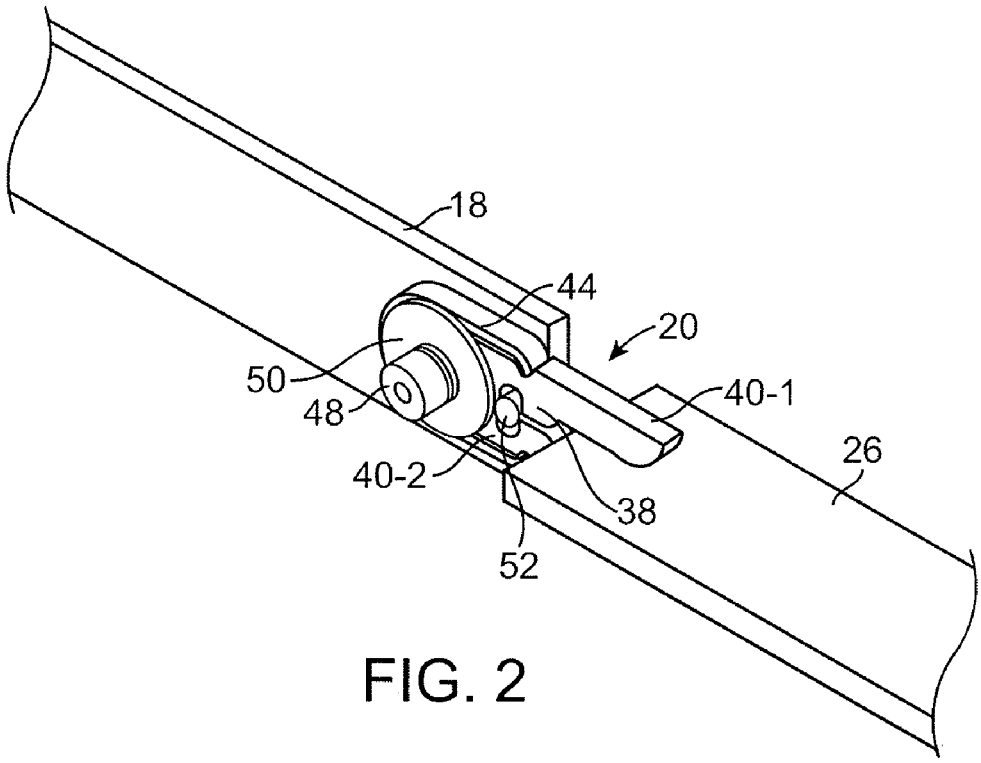
FIG. 2 is an isometric view of a pair of busbars connected by a busbar connector.
Figure 3:
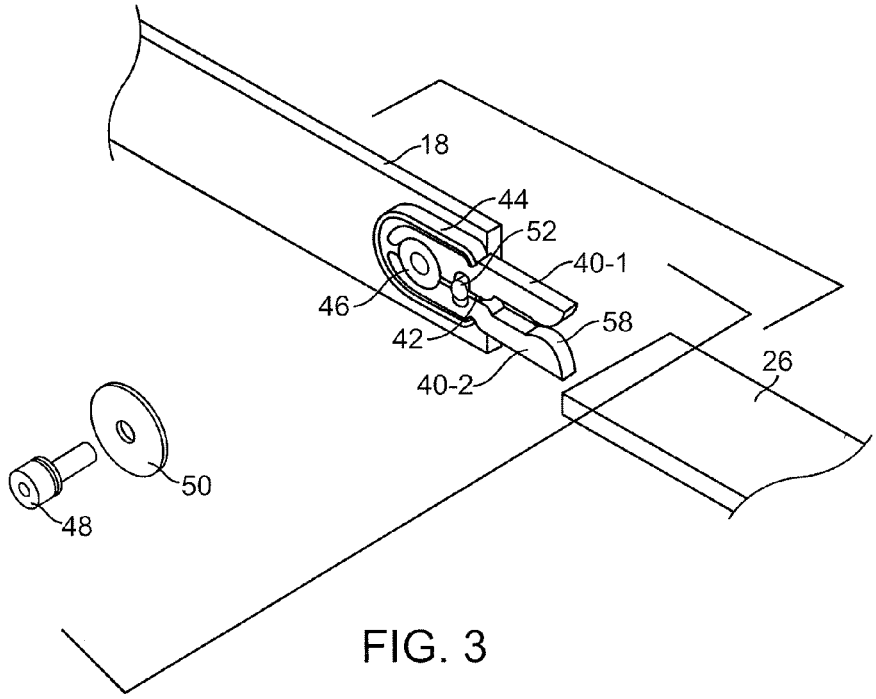
FIGS. 3-5 are partially exploded views of the busbars and the busbar connector of FIG. 2.
Figure 4:
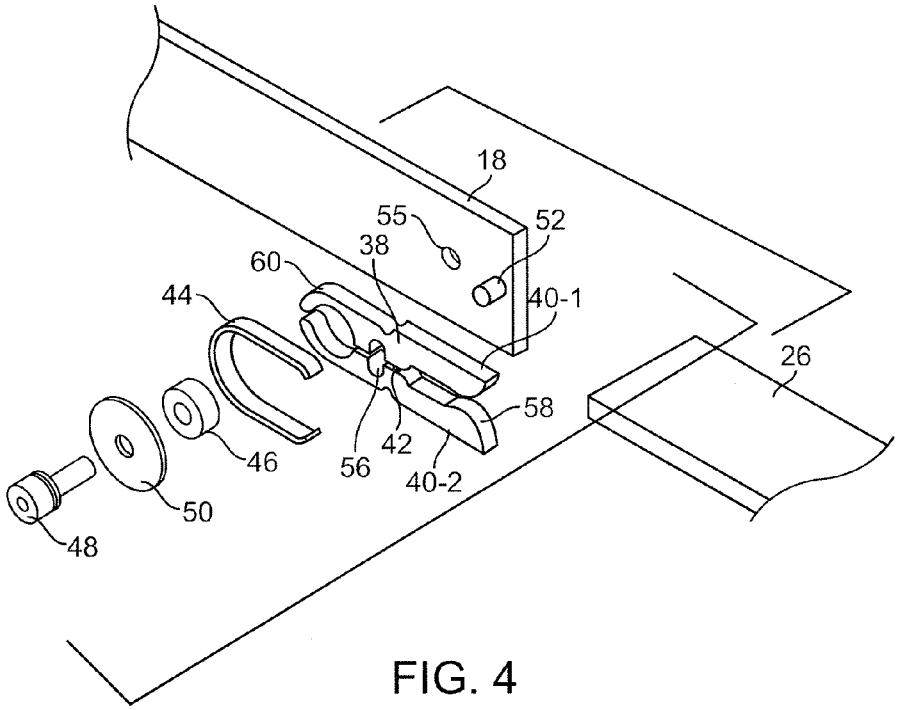
Figure 5:
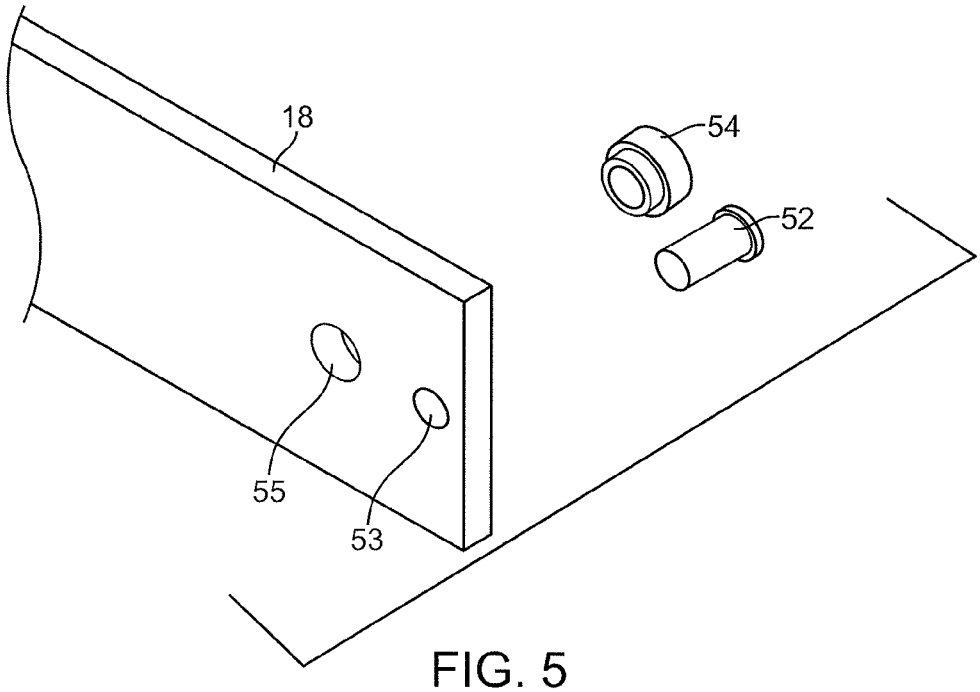
Figure 6:
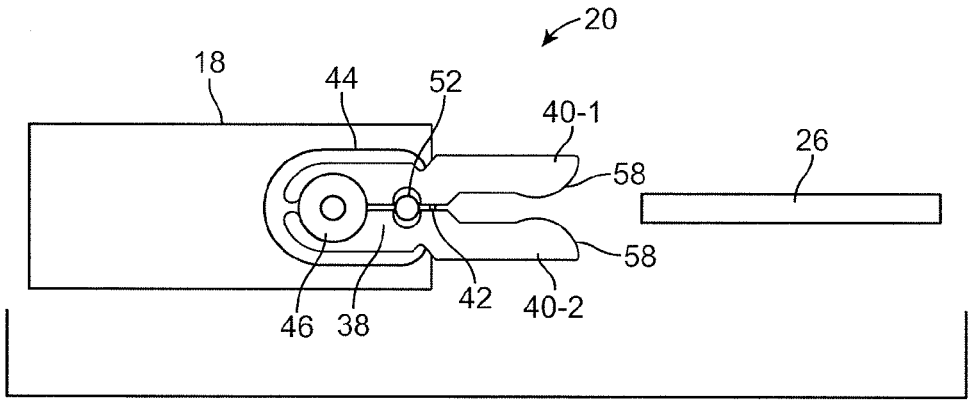
FIG. 6 is a side view of the busbars and busbar connector of FIG. 2.

At stage 112, a pivot rod is attached to a base busbar. For example, the pivot rod is the combination of the conducting ring 46 and anchor screw 48 attached to the anchor nut 54 as shown in FIG. 2-4. At stage 114, the conductive fork 38 is positioned to receive the pivot rod. The arm members 40 of the conductive fork 38 are connected by the mechanical connector 42. The mechanical connector 42 connects the arm members in fixed relation to each other such that the conductive fork 38 can be positioned around the pivot rod manually without the mechanical member 42 breaking, without complex positioning machinery.

At stage 116, a bias member (e.g., the spring 44) is connected to the arm members 40. The bias member can be attached by slipping the spring 44 over the arm members 40 such that the curved front ends of the spring 44 slide into the indentations of the spring contact points 64. The bias member can also be a coil spring or a piece of elastic material or band.

Upon connecting the bias member at the stage 116, the mechanical connector 42 is no longer necessary to connect the arm members 40 in fixed relation since the bias member is causing the pivot portions 60 to grip the pivot rod. Preferably, the mechanical connector remains in place. Alternatively, the mechanical connector can be removed. For example, if the mechanical connector is press-fit into the arm members 40, as discussed below in reference to a mechanical connector 42-3 in FIG. 10, then the mechanical connector can be pulled out of the press-fit slots.

At stage 118, an opposing busbar is inserted between the electrical contact ends 58 of the conductive fork 38. The force of inserting the opposing bus bar causes the mechanical connector 42 to yield. Preferably, the mechanical connector 42 yields by breaking. The mechanical connector could be stretched, bent, pulled out of a press-fit slot, or caused to yield in some other way to allow the arm members to pivot about the pivot rod. Preferably the opposing busbar is inserted manually.

Figure 9:
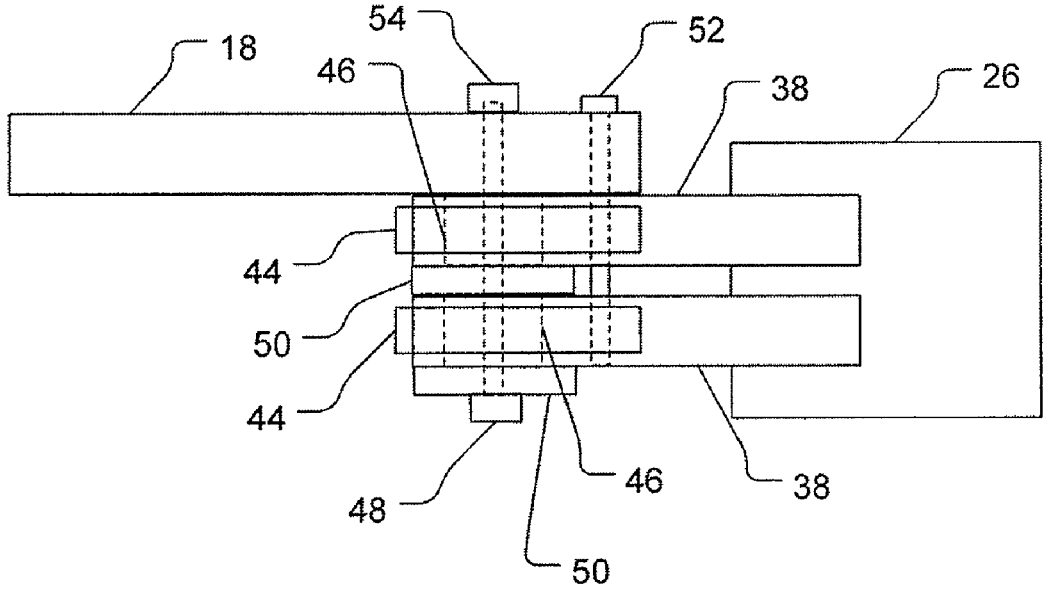
FIG. 9 illustrates an alternative embodiment of a busbar connector that includes two electrically conductive forks.

Referring to FIG. 9, a busbar connector includes two conductive forks 38. This embodiment can provide twice the current carrying capacity as the busbar connector 20 illustrated in FIGS. 2-6 having a single conductive fork 38. Each of the conductive forks 38 and 38 has an associated spring 44 and 44, respectively. The springs 44 hold the arm members 40 of the conductive forks 38 against separate conducting rings 46. The arm members 40 of the conductive forks 38 rotate independently to help receive a misaligned opposing busbar 26.

Two washers 50 are used to secure the conducting rings 46 to the base busbar 18 via the anchor screw 48 and the anchor nut 54. The conducting rings 46 are wider than the conductive forks 38 such that the conducting rings 462 are secured to the base busbar 18, while the arm members 40 of the conductive forks 38 can rotate around the conducting rings 46. The stud 52 extends through stud-cutout portions of both conductive forks 38-1 and 38-2, and limits the rotation of the arm members 40. Alternative embodiments include using a single washer 50 with two conducting rings 46 side-by-side or a single washer 50 and a single conducting ring 46 long enough to contact both conductive forks 38.

The busbar connectors 20 illustrated in the electrical system 10 of FIG. 1 and illustrated in FIGS. 2-9 are not insulated due to their isolated location within the housing 12 where the exposed surfaces do not pose a safety threat. However, if the busbar connectors 20 are located in the open, or in close proximity to other exposed electrical connections (e.g., wires), then insulation is preferably added to the busbar connectors. This could be accomplished by encasing the busbar connector in a plastic housing that exposes only the electrical contacts at the end of the busbar connector that receives the opposing busbar 26. Alternatively, the exposed surfaces of the busbar connector parts could be coated with an insulating material with only the electrical contacts not being insulated.

Figure 10:
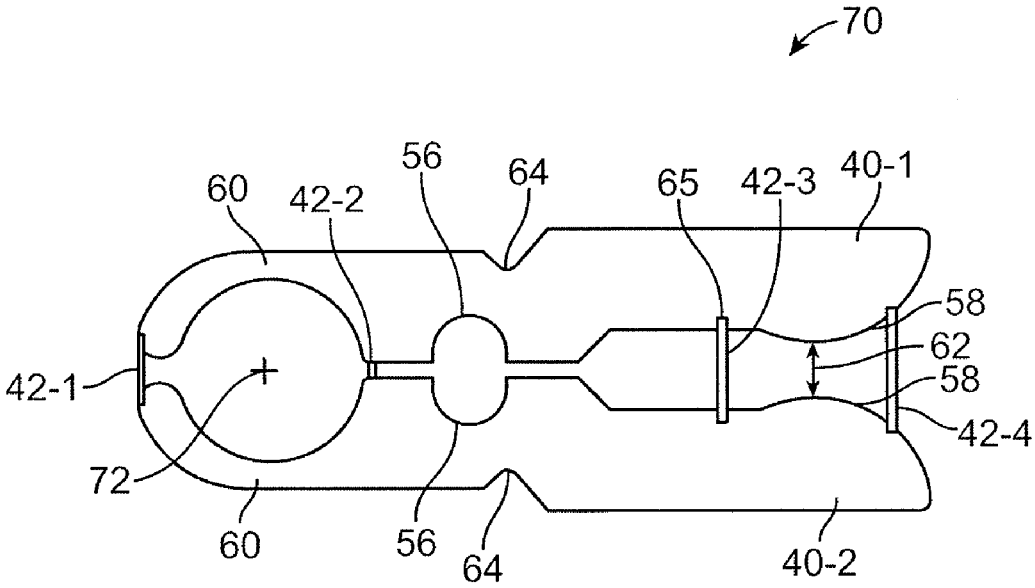
FIG. 10 is a side view of another embodiment of a conductive fork member for a busbar connector.

Referring to FIG. 10, another conductive fork member 70 includes four mechanical connectors 42-1, 42-2, 42-3 and 42-4. The mechanical connectors 42 provide mechanical stability between the arm members 40-1 and 40-2 while being attached to the base busbar 18. One or more of the mechanical connectors 42 could be used for connecting the arm members 40-1 and 40-2. Preferably, insertion of the opposing busbar into a gap 62 of the conductive fork 38 breaks the mechanical connector(s) 42 to allow the arm members 40 to rotate independently about a pivot point 72. The mechanical connector (s) 42 could, however, deform and not break. For example, the mechanical connector 42-1 could be deformed (e.g., bent) upon insertion of the opposing busbar 26 into the gap 62.

The mechanical connector 42-2 is located closer to the pivot point 72 than the mechanical connectors 42 illustrated in FIGS. 2-8. This location offers a larger moment arm between the rounded contact ends 58 and the mechanical connector 42-2, thereby increasing the tensile force induced on the mechanical connector 42-2 by insertion of the opposing busbar 26. This increased tensile force could result in easier breaking of the mechanical connector 42-2 compared to the mechanical connector 42 of FIGS. 2-8. However, the amount of stretching that occurs at the mechanical connector 42-2 is less than the stretching that occurs with the mechanical connectors located further from the pivot point 72. Positions experiencing larger amounts of stretching (i.e., larger separation off the arm members 40) could be desirable to break a mechanical connector 42.

The mechanical connectors 42-3 and 42-4 are breakable connectors disposed such that the opposing busbar 26 pushes against the mechanical connector 42-3 and/or 42-4 during insertion and breaks the mechanical connector 42-3 and/or 42-4. Here, the mechanical connector 42-3 is a separate piece that is inserted into slots 65 formed in each of the arm members 40-1 and 40-2. The mechanical connector 42-3 is sized to be press fit into the slots 65 and holds the arm members 40-1 and 40-2 in fixed relation to each other. As an alternative to breaking the mechanical connector 42-3 upon insertion of the opposing busbar 26, the mechanical connector 42-3 could be manually removed, e.g., using a removal tool such as pliers, subsequent to the conductive fork 38 being attached to the base busbar 18.

When the mechanical connector 42 is configured to be broken, the dimensions of the mechanical connector 42, the gap 52 and the opposing busbar thickness are configured to allow manual insertion of the opposing busbar 26 to break the mechanical connector 42 with a force of about 50 N or less to push the busbar between the electrical contacts 58. The mechanical connector 42 is preferably large enough to be manufactured by molding or laser cutting.

Figure 11:
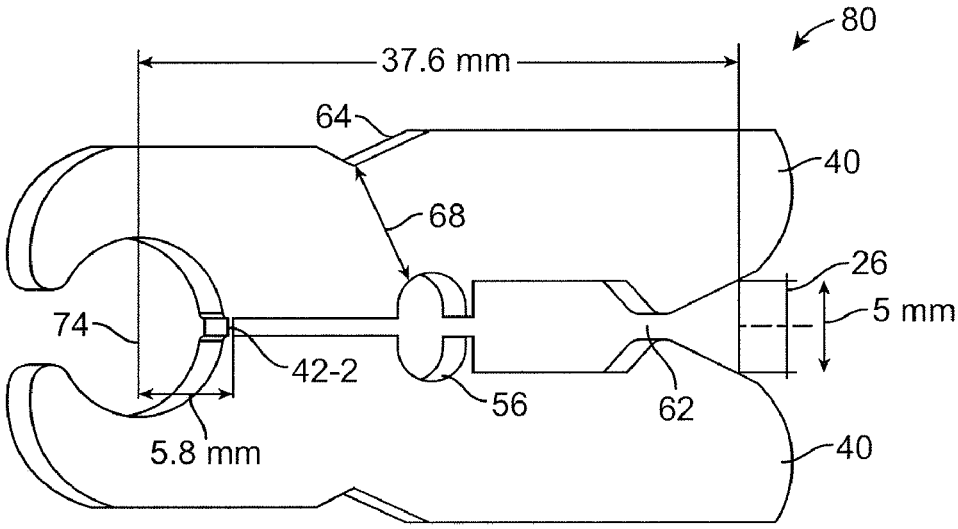
FIG. 11 is an isometric view of another embodiment of a conductive fork member for a busbar connector.

Referring to FIG. 11, a force for breaking one of the mechanical connectors can be determined based on dimensions of the conductive forks 80. The conductive fork 80 includes a mechanical connector 42-2 made of copper. The gap 62 is about 1 mm and the opposing busbar 26 is 5 mm thick. Insertion of the 5 mm thick opposing busbar 26 will force the arm members 40 to be separated by an additional 4 mm. The mechanical connector 42-2 is 3 mm wide (the thickness of the arm members 40), and about 0.3 mm thick, resulting in a cross sectional area of 0.9 $mm^2$. Assuming that the tensile strength of copper is 380 $N/mm^2$, the tensile force to break the mechanical connector is 380 times 0.9, or 342 N (about 76.9 lbs.). In this example, the mechanical connector 42-2 is 5.8 mm from pivot point 74 of the arm members 40 and the busbar contacts the electrical contacts at a point 37.6 mm from the pivot point 74. Therefore the horizontal force to insert the 5 mm busbar and to produce the 342 N tensile force to break the mechanical connector 42-2 can be approximated as 342*(5.8/37.6), or about 52.8 N (about 11.9 lbs.). This is a low enough force that a person could push on the opposing busbar 26 (or push on a subsystem module 24 containing the opposing busbar 26 as shown in the electrical system 10 of FIG. 1) and break the mechanical connector 42-2. If the mechanical connector is located at another location, the breaking force required could be higher or lower depending on the location of the mechanical connector relative to the pivot point and the ends of the arm members 40 where the busbar 26 makes contact.

The conductive fork 38 is sized based on a desired level of current to be transferred. With reference to the conductive fork 80 of FIG. 11, the current able to be transferred is limited by the cross sectional area of the minimum distance 68 between the stud-slot 56 and a spring contact point 64 where the spring member 44 contacts one of the arm members 40. In this example, the minimum distance is 7.41 mm. Since the arm members 40 are 3 mm thick, the minimum cross sectional area is 22.23 $mm^2$. In this example, the maximum current that the arm members 40 are designed for is about 50 amp. With a 22.23 $mm^2$ cross section at the minimum distance point 68, the current density is about 2.25 $amp/mm^2$, which is within the current carrying capability of copper, for example.

Figure 13:
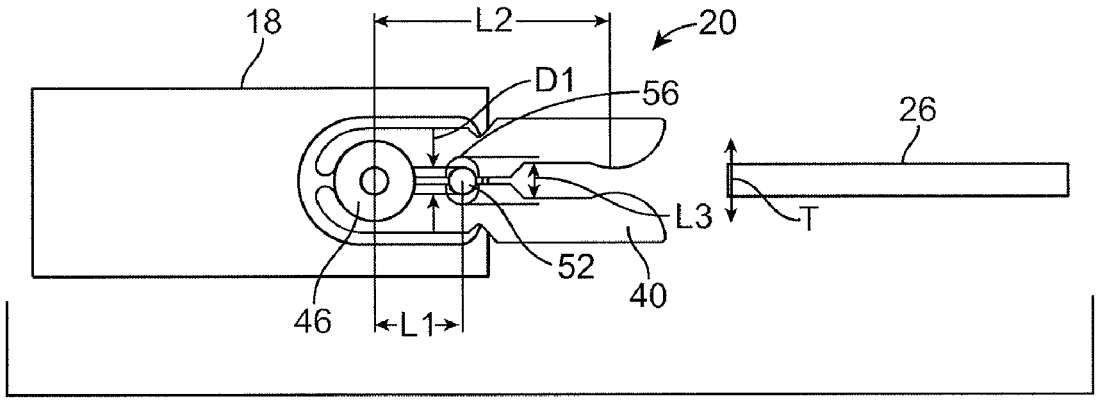
FIG. 13 is a side view similar to FIG. 6, but with various dimensions noted.

FIG. 13 illustrates dimensions of a busbar connector 20 that are used to calculated a tolerance T that the opposing busbar 26 can be misaligned and still be received by the busbar connector 20. The tolerance T that the opposing busbar 26 can be misaligned is dependent on four dimensions: 1) the distance L1 between the pivot point of the conducting ring 46 and the center of the stud 52, 2) the distance L2 between the pivot point of the conducting ring 46 and the contact points of the arm members 38, 3) the length L3 of the stud cutout portion 56, and 4) the diameter D1 of the stud 52. The tolerance T can be calculated by equation (1):

$$T = 2 * \frac{[(L3 - D1)/2] * L2}{L1} \quad (1)$$

The arm members 40 can move a vertical distance of T/2 in both directions. The tolerance T that the busbar can be misaligned is limited by the length L3 of the stud cutout portion 56 and the diameter D1 of the stud 52. For example, for a busbar connector 20 with L1=18.4 mm, L2=34 mm, L3=6.2 mm, and D1=3 mm, the tolerance T given by Equation (1) is about 5.8 mm. This means that in this example the opposing busbar 26 can be misaligned by about +/−2.9 mm from the center of the arm members 40. These dimensions are merely an example and other dimensions could be used.

Other embodiments of busbar connectors may be used. For example, the anchor screw 48 and conducting ring 46 can be replaced with a single conductive rod that the arm members rotate about. The single conductive rod can be attached to the base busbar by threads on the rod and threads in a hole formed in the busbar or in an anchor nut secured in the hole. The rounded contact ends 58 can be replaced by electrical contact ends having other contours, e.g., flat, that are non-perpendicular (e.g., see FIG. 11) to the direction of insertion of the opposing busbar 26 and respond to insertion of the busbar to move the electrical contacts away from each other.

More than one invention may be described herein.

What is claimed is:

1. An electrically conductive fork comprising:

a first arm member and a second arm member, each arm member having an electrical contact and a pivot portion, the pivot portion configured to receive a portion of a rod, wherein the first arm member and the second arm member are configured to pivot around the rod; and a connector mechanically connecting the first arm member and the second arm member in fixed relation to each other prior to insertion of a busbar between the electrical contacts, wherein the connector is configured to yield to a force imparted on the connector and allow the first arm member and the second arm member to pivot around the rod in response to insertion of the busbar between the electrical contacts, and the insertion of the bus bar causes the electrical contacts to separate and pivot the first arm member and the second arm member around the rod and impart the force on the connector.

2. The electrically conductive fork of claim 1, wherein the connector is configured to yield to the force imparted on the connector by breaking upon insertion of the busbar between the contact points.

3. The electrically conductive fork of claim 1, wherein the connector is press fit into a slot of at least one of the first arm member and the second arm member and the connector is configured to yield to the force imparted on the connector by pulling out of the slot upon insertion of the busbar between the contact points.

4. The electrically conductive fork of claim 1, wherein the connector and at least one of the first arm member and the second arm member are a monolithic piece.

5. The electrically conductive fork of claim 1, wherein the connector and both the first arm member and the second arm member are a monolithic piece.

6. The electrically conductive fork of claim 1, wherein the connector mechanically connects the first arm member and the second arm member such that the electrical contacts of the first and second arm members are separated by a gap.

7. The electrically conductive fork of claim 6, wherein the gap is in a range from about 1 mm to about 3 mm.

8. The electrically conductive fork of claim 1, wherein the first arm member and the second arm member are configured to transfer an electrical current greater than about 100 amps.

9. An electrically conductive fork comprising:

first and second conductor means for transferring electrical current from a first busbar to a second busbar, the first and second conductor means each comprising:

means for contacting the first busbar, and pivot means coupled to the contacting means, the pivot means for receiving a rod connected to the second busbar and for pivoting around the rod; and connector means for mechanically connecting the first conductor means and the second conductor means in fixed relation to each other prior to insertion of the first busbar between the contacting means of the first and second conductor means, and for yielding to a force imparted on the connector means and allowing the pivot means of the first and second conductor means to pivot around the rod in response to insertion of the first busbar between the contacting means, the insertion of the bus bar causing the contacting means to separate and causing the pivot means of the first and second conductor means to pivot around the rod and impart the force on the connector means.

10. The electrically conductive fork of claim 9, wherein the connector means is configured to yield to the force imparted on the connector means by breaking upon insertion of the first busbar between the contacting means.

11. The electrically conductive fork of claim 9, wherein the connector means is press fit into a slot of at least one of the first and the second conductor means and the connector means is configured to yield to the force imparted on the connector means by withdrawing from the slot upon insertion of the first busbar between the contacting means.

12. The electrically conductive fork of claim 9, wherein the connector means and at least one of the first conductor means and the second conductor means are a monolithic piece.

13. The electrically conductive fork of claim 9, wherein the connector means and both the first conductor means and the second conductor means are a monolithic piece.

14. The electrically conductive fork of claim 9, wherein the connector means mechanically connects the first conductor means and the second conductor means such that the contacting means of the first and second conductor means are separated by a gap.

15. The electrically conductive fork of claim 14, wherein the gap is in a range from about 1 mm to about 3 mm.

16. The electrically conductive fork of claim 9, wherein the first conductor means and the second conductor means are configured to transfer an electrical current greater than about 100 amps.

* * * * *